US006318922B1

(12) United States Patent
Briggs

(10) Patent No.: US 6,318,922 B1
(45) Date of Patent: Nov. 20, 2001

(54) CLEANING IMPLEMENT

(76) Inventor: Patrick F. Briggs, 234 Stockwood La., Stanley, NC (US) 28164

( * ) Notice: Subject to any disclaimer, the term of this patent is extended or adjusted under 35 U.S.C. 154(b) by 0 days.

(21) Appl. No.: 09/687,083

(22) Filed: Oct. 13, 2000

(51) Int. Cl.[7] ..... A41K 7/02
(52) U.S. Cl. ..... 401/201; 206/77.1
(58) Field of Search ..... 401/201, 196, 401/200, 6, 7, 8; 206/77.1

(56) References Cited

U.S. PATENT DOCUMENTS

| | | | | |
|---|---|---|---|---|
| D. 317,401 | | 6/1991 | Earnest . | |
| 1,469,029 | * | 9/1923 | Underwood et al. | 401/201 |
| 1,469,917 | * | 10/1923 | Dessau | 401/201 |
| 2,163,324 | * | 6/1939 | Reinhold | 401/201 |
| 2,635,273 | * | 4/1953 | Logan | 401/201 |
| 2,669,737 | * | 2/1954 | Evans | 401/201 |
| 2,958,885 | | 11/1960 | Dooney . | |
| 3,775,014 | * | 11/1973 | Rosborne | 401/201 |
| 4,159,883 | * | 7/1979 | Mizell | 401/201 |
| 4,228,834 | * | 10/1980 | Desnick | 401/201 |
| 4,457,640 | | 7/1984 | Anderson . | |
| 4,457,643 | * | 7/1984 | Caniglia | 401/201 |
| 5,031,759 | | 7/1991 | Ogilvie . | |
| 5,462,378 | | 10/1995 | Webb . | |

* cited by examiner

*Primary Examiner*—Charles R. Eloshway

(57) ABSTRACT

A cleaning implement for holding a bar of soap therein for efficient displacement of soap on the body. The cleaning implement includes a housing. The housing has a bottom wall, a front wall, a back wall and a pair of lateral side walls such that a top side of the housing has an opening therein for access to an inside of the housing. Each of the bottom, front, back and lateral side walls has a plurality of holes extending therethrough. The housing comprises a cloth material. A flap selectively opens and closes the top side of the housing. The flap has a back edge integrally coupled to and extending along a length of a top edge of the back wall. The flap comprises a cloth material. The flap has a plurality of holes therein.

13 Claims, 2 Drawing Sheets

CLEANING IMPLEMENT

BACKGROUND OF THE INVENTION

1. Field of the Invention

The present invention relates to bathing devices and more particularly pertains to a new cleaning implement for holding a bar of soap therein for efficient displacement of soap on the body.

2. Description of the Prior Art

The use of bathing devices is known in the prior art. More specifically, bathing devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 2,958,885; U.S. Pat. No. 4,457,640; U.S. Pat. No. 4,228,834; U.S. Pat. No. 5,031,759; U.S. Pat. No. 5,462,378; and U.S. Des. Pat. No. 317,401.

While these devices fulfill their respective, particular objectives and requirements, the aforementioned patents do not disclose a new cleaning implement. The inventive device includes a housing. The housing has a bottom wall, a front wall, a back wall and a pair of lateral side walls such that a top side of the housing has an opening therein for access to an inside of the housing. Each of the bottom, front, back and lateral side walls has a plurality of holes therethrough. The housing comprises a cloth material. A flap selectively opens and closes the top side of the housing. The flap has a back edge integrally coupled to and extending along a length of a top edge of the back wall. The flap comprises a cloth material. The flap has a plurality of holes therein.

In these respects, the cleaning implement according to the present invention substantially departs from the conventional concepts and designs of the prior art, and in so doing provides an apparatus primarily developed for the purpose of holding a bar of soap therein for efficient displacement of soap on the body.

SUMMARY OF THE INVENTION

In view of the foregoing disadvantages inherent in the known types of bathing devices now present in the prior art, the present invention provides a new cleaning implement construction wherein the same can be utilized for holding a bar of soap therein for efficient displacement of soap on the body.

The general purpose of the present invention, which will be described subsequently in greater detail, is to provide a new cleaning implement apparatus and method which has many of the advantages of the bathing devices mentioned heretofore and many novel features that result in a new cleaning implement which is not anticipated, rendered obvious, suggested, or even implied by any of the prior art bathing devices, either alone or in any combination thereof.

To attain this, the present invention generally comprises a housing. The housing has a bottom wall, a front wall, a back wall and a pair of lateral side walls such that a top side of the housing has an opening therein for access to an inside of the housing. Each of the bottom, front, back and lateral side walls has a plurality of holes extending therethrough. The housing comprises a cloth material. A flap selectively opens and closes the top side of the housing. The flap has a back edge integrally coupled to and extending along a length of a top edge of the back wall. The flap comprises a cloth material. The flap has a plurality of holes therein.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new cleaning implement apparatus and method which has many of the advantages of the bathing devices mentioned heretofore and many novel features that result in a new cleaning implement which is not anticipated, rendered obvious, suggested, or even implied by any of the prior art bathing devices, either alone or in any combination thereof.

It is another object of the present invention to provide a new cleaning implement which may be easily and efficiently manufactured and marketed.

It is a further object of the present invention to provide a new cleaning implement which is of a durable and reliable construction.

An even further object of the present invention is to provide a new cleaning implement which is susceptible of a low cost of manufacture with regard to both materials and labor, and which accordingly is then susceptible of low prices of sale to the consuming public, thereby making such cleaning implement economically available to the buying public.

Still yet another object of the present invention is to provide a new cleaning implement which provides in the apparatuses and methods of the prior art some of the advantages thereof, while simultaneously overcoming some of the disadvantages normally associated therewith.

Still another object of the present invention is to provide a new cleaning implement for holding a bar of soap therein for efficient displacement of soap on the body.

Yet another object of the present invention is to provide a new cleaning implement which includes a housing. The housing has a bottom wall, a front wall, a back wall and a pair of lateral side walls such that a top side of the housing has an opening therein for access to an inside of the housing. Each of the bottom, front, back and lateral side walls has a plurality of holes extending therethrough. The housing comprises a cloth material. A flap selectively opens and closes the top side of the housing. The flap has a back edge integrally coupled to and extending along a length of a top edge of the back wall. The flap comprises a cloth material. The flap has a plurality of holes therein.

Still yet another object of the present invention is to provide a new cleaning implement that has a gripping member thereon for placement around the hand of a user for ease of use.

Even still another object of the present invention is to provide a new cleaning implement that has a hanging member thereon for hanging the device when not in use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
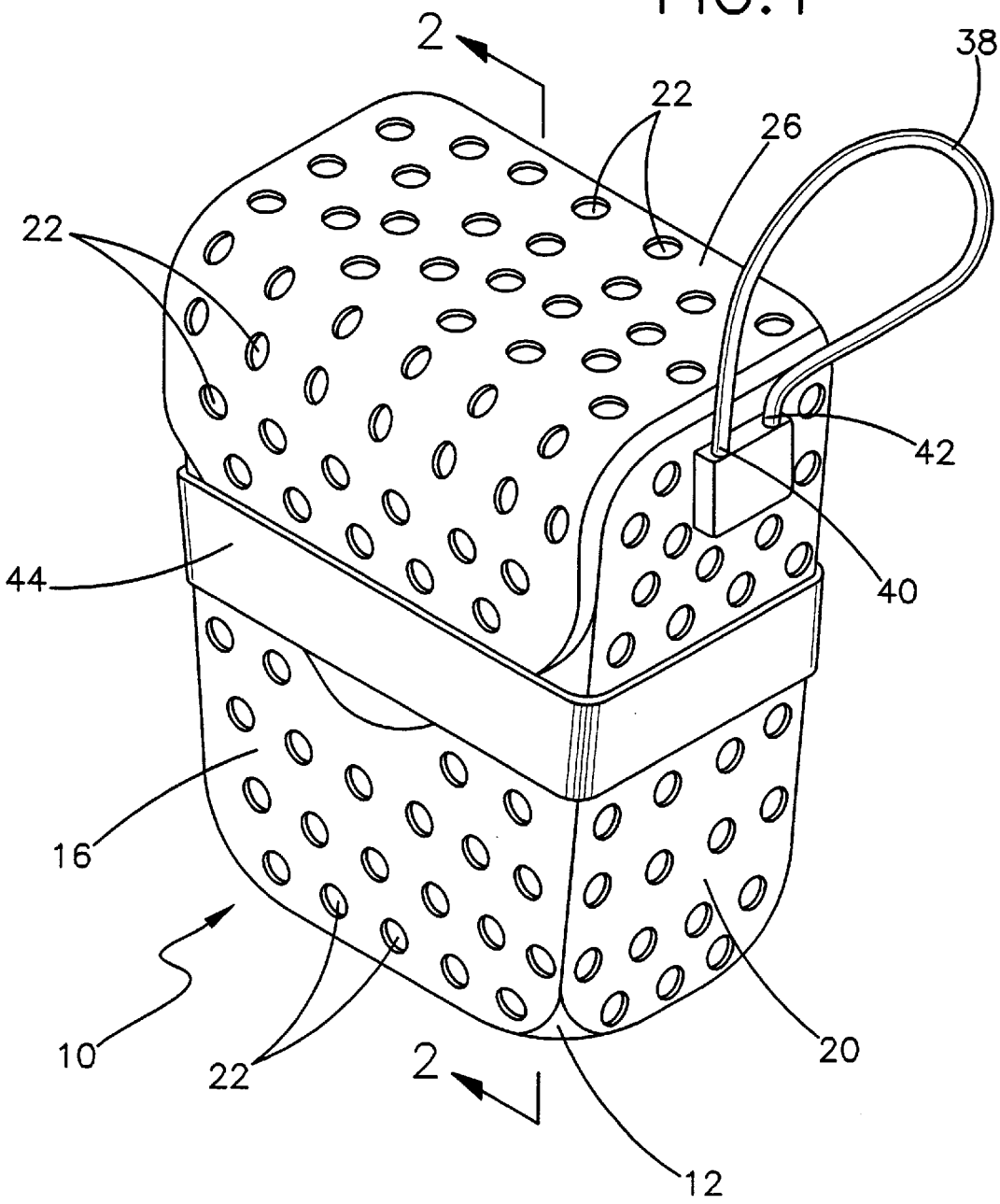
FIG. 1 is a schematic perspective view of a new cleaning implement according to the present invention.
Figure 2:
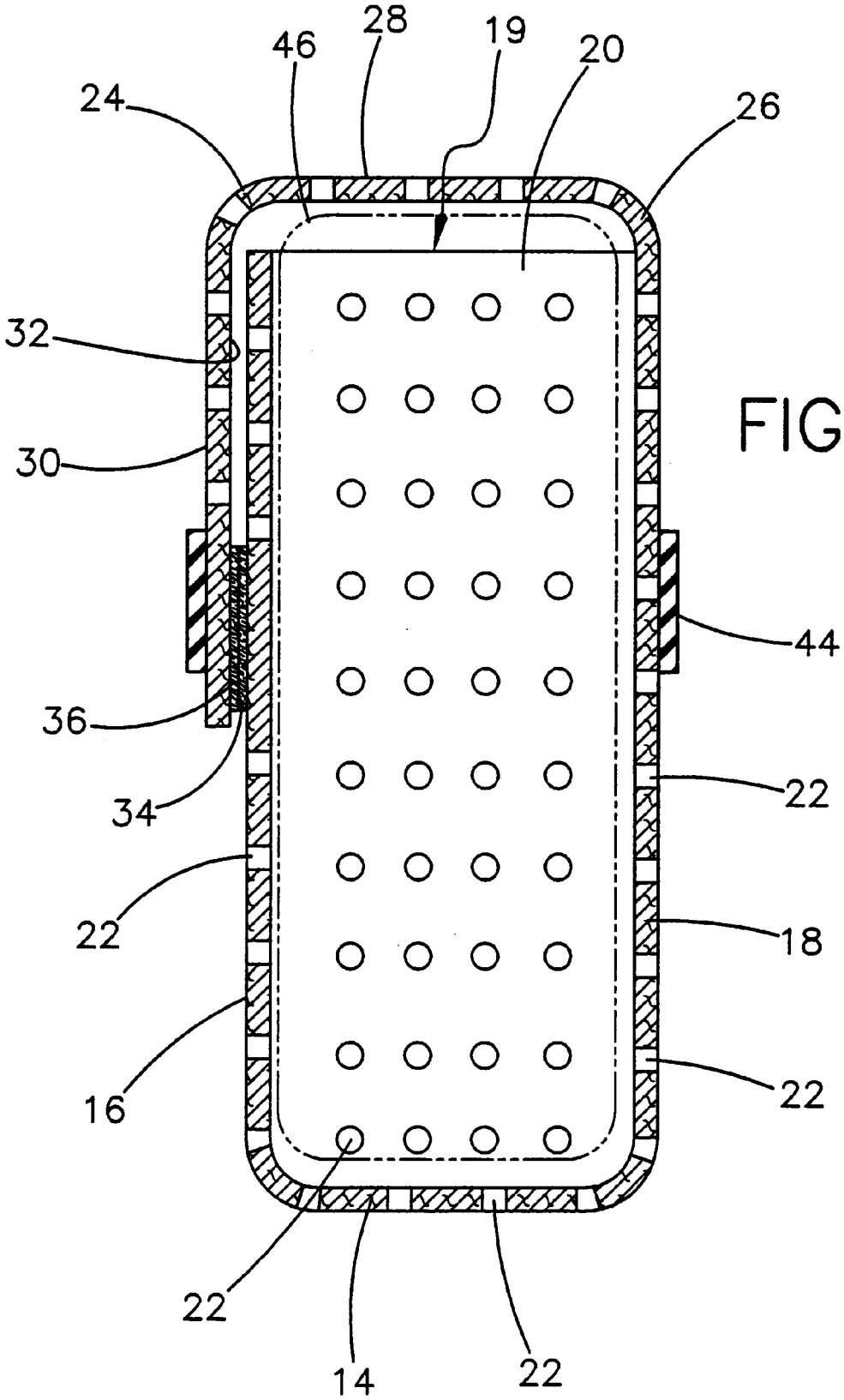
FIG. 2 is a schematic cross-sectional view taken along lines 2—2 of the present invention.

With reference now to the drawings, and in particular to FIGS. 1 and 2 thereof, a new cleaning implement embodying the principles and concepts of the present invention and generally designated by the reference numeral 10 will be described.

As best illustrated in FIGS. 1 and 2 the cleaning implement generally comprises a housing 12. The housing 12 has a bottom wall 14, a front wall 16, a back wall 18 and a pair of lateral side walls 20 such that a top side of the housing 12 has an opening 19 therein for access to an inside of the housing 12. Each of the bottom 14, front 16, back 18 and lateral side 20 walls has a plurality of holes 22 therethrough. The housing 12 comprises a cloth material, which is ideally a cotton material.

A flap 24 for selectively opening and closing the top side of the housing 12 has a back edge 26 integrally coupled to and extending along a length of a top edge of the back wall 18. The flap 24 has a first portion 28 and a second portion 30. The first portion 28 is positionable over the opening 19. The second portion 30 has an inner surface 32 that is abuttable against the front wall 16. The flap 24 comprises a cloth material, which is ideally a cotton material. The flap 24 has a plurality of holes 22 therein.

A securing means removably secures the flap 24 to the front wall 16. The securing means comprises a hook and loop securing means having a loop portion 34 and a hook portion 36. The hook portion 36 is securely coupled to the inner surface 32 of the second portion 30 of the flap 24. The loop portion 34 is securely coupled to the front wall 16 and positioned such that the hook portion 36 may be abutted against the loop portion 34.

A hanging member 38 for hanging the housing 12 comprises an elongate flexible member having a first end 40 and a second end 42. One of the lateral side walls 20 has both of the first 40 and second 42 ends securely coupled thereto. The first 40 and second 42 ends are positioned generally adjacent to each other.

A gripping member 44 for gripping the housing 12 comprises a loop positioned around the housing 12 such that the loop is abutting the front 16, back 18, and lateral side 20 walls. The loop is securely coupled to the back wall 18. The loop preferably comprises an elastomeric material, though a cloth having elastic properties is also envisioned.

In use, a bar of soap 46 is positioned in the housing 12 and the flap 24 closed over the bar of soap 46. The user washes themselves with the device 10 and soap leaves the bar and travels through the holes 22 and through the housing 12 itself. When a new bar is needed, it is placed in the housing and the flap closed again.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bathing device for removably storing a bar of soap therein comprising;

a housing, said housing having a bottom wall, a front wall, a back wall and a pair of lateral side walls such that a top side of said housing has an opening therein for access to an inside of said housing, each of said bottom, front, back and lateral side walls having a plurality of holes therethrough, said housing comprising a cloth material;

a flap for selectively opening and closing said top side of said housing, said flap having a back edge integrally coupled to and extending along a length of a top edge of said back wall, said flap comprising a cloth material, said flap having a plurality of holes therein;

a hanging member for hanging said housing therefrom; and a gripping member encircling said housing and overlying said flap.

2. The bathing device as in claim 1, wherein said flap further comprises:

said flap having a first portion and a second portion, said first portion being positionable over said opening, said second portion having an inner surface being abuttable against said front wall.

3. The bathing device as in claim 2, further comprising:

a securing means for selectively securing said second portion of said flap to said front wall.

4. The bathing device as in claim 3, wherein said securing means further comprises:

said securing means comprising a hook and loop fastener having a loop portion and a hook portion, said hook portion being securely coupled to said inner surface of said second portion of said flap, said loop portion being securely coupled to said front wall and positioned such that said hook portion may be abutted against said loop portion.

5. The bathing device as in claim 1, wherein said hanging member comprises an elongate flexible member having a first end and a second end, one of said lateral side walls having both of said first and second ends securely coupled thereto.

6. The bathing device as in claim 1, wherein said gripping member comprises a loop, said loop being positioned around said housing such that said loop is abutting said front, back, and lateral side walls, said loop being securely coupled to said back wall.

7. A bathing device for removably storing a bar of soap therein comprising;

a housing, said housing having a bottom wall, a front wall, a back wall and a pair of lateral side walls such that a top side of said housing has an opening therein for access to an inside of said housing, each of said bottom, front, back and lateral side walls having a plurality of holes therethrough, said housing comprising a cloth material, said cloth material comprising a cotton material;

a flap for selectively opening and closing said top side of said housing, said flap having a back edge integrally coupled to and extending along a length of a top edge of said back wall, said flap having a first portion and a second portion, said first portion being positionable over said opening, said second portion having an inner surface being abuttable against said front wall, said flap comprising a cloth material, said flap having a plurality of holes therein;

a securing means for selectively securing said flap to said front wall, said securing means comprising a hook and loop fastener having a loop portion and a hook portion, said hook portion being securely coupled to said inner surface of said second portion of said flap, said loop portion being securely coupled to said front wall and positioned such that said hook portion may be abutted against said loop portion;

a hanging member for hanging said housing, said hanging member comprising an elongate flexible member having a first end and a second end, one of said lateral side walls having both of said first and second ends securely coupled thereto, said first and second ends being positioned generally adjacent to each other; and a gripping member for gripping said housing, said gripping member comprising a loop, said loop being positioned around said housing such that said loop is abutting said front, back, and lateral side walls and overlying said flap, said loop being securely coupled to said back wall, said loop comprising an elastomeric material.

8. A bathing device for removably storing a bar of soap therein comprising:

a bar of soap a housing, said housing having a bottom wall, a front wall, a back wall and a pair of lateral side walls such that a top side of said housing has an opening therein for access to an inside of said housing, each of said bottom, front, back and lateral side walls having a plurality of holes therethrough, said housing comprising a cloth material;

a flap for selectively opening and closing said top side of said housing, said flap having a back edge integrally coupled to and extending along a length of a top edge of said back wall, said flap comprising a cloth material, said flap having a plurality of holes therein;

a hanging member for hanging said housing therefrom; and a gripping member encircling said housing and overlying said flap.

9. The bathing device as in claim 8, wherein said flap further comprises:

said flap having a first portion and a second portion, said first portion being positionable over said opening, said second portion having an inner surface being abuttable against said front wall.

10. The bathing device as in claim 9, further comprising:

a securing means for selectively securing said second portion of said flap to said front wall.

11. The bathing device as in claim 10, wherein said securing means further comprises:

said securing means comprising a hook and loop fastener having a loop portion and a hook portion, said hook portion being securely coupled to said inner surface of said second portion of said flap, said loop portion being securely coupled to said front wall and positioned such that said hook portion may be abutted against said loop portion.

12. The bathing device as in claim 8, wherein said hanging member comprises an elongate flexible member having a first end and a second end, one of said lateral side walls having both of said first and second ends securely coupled thereto.

13. The bathing device as in claim 8, wherein said gripping member comprises a loop, said loop being positioned around said housing such that said loop is abutting said front, back, and lateral side walls, said loop being securely coupled to said back wall.

* * * * *